US008545961B2

(12) United States Patent
Winkler et al.

(10) Patent No.: US 8,545,961 B2
(45) Date of Patent: Oct. 1, 2013

(54) BALLISTIC RESISTANT ARTICLES COMPRISING ELONGATE BODIES

(75) Inventors: Ernst Michael Winkler, Arnhem (NL); Erik Oscar Nienhuis, 's-Heerenberg (NL); Soon Joo Bovenschen, Arnhem (NL); Edo Mugge, Wijchen (NL)

(73) Assignee: Teijin Aramid B.V., Arhem (NL)

( * ) Notice: Subject to any disclaimer, the term of this patent is extended or adjusted under 35 U.S.C. 154(b) by 324 days.

(21) Appl. No.: 12/920,608

(22) PCT Filed: Mar. 5, 2009

(86) PCT No.: PCT/EP2009/052622

§ 371 (c)(1),
(2), (4) Date: Sep. 2, 2010

(87) PCT Pub. No.: WO2009/109632

PCT Pub. Date: Sep. 11, 2009

(65) Prior Publication Data

US 2011/0020593 A1 Jan. 27, 2011

(30) Foreign Application Priority Data

Mar. 6, 2008 (EP) ..... 08004144
Jan. 9, 2009 (EP) ..... 09150308

(51) Int. Cl.
*B32B 5/12* (2006.01)

(52) U.S. Cl.
USPC ..... 428/105; 428/107; 428/156; 428/213; 428/364

(58) Field of Classification Search
USPC ..... 428/105, 107, 156, 213, 364
See application file for complete search history.

(56) References Cited

U.S. PATENT DOCUMENTS

| | | | | |
|---|---|---|---|---|
| 4,953,234 | A | 9/1990 | Li et al. | |
| 5,167,876 | A | 12/1992 | Lem et al. | |
| 6,183,834 | B1 * | 2/2001 | van der Loo | 428/107 |
| 2006/0142521 | A1 | 6/2006 | Rastogi et al. | |

FOREIGN PATENT DOCUMENTS

| | | | |
|---|---|---|---|
| EP | 0 833 742 | B1 | 9/2002 |
| EP | 1 627 719 | A1 | 2/2006 |
| EP | 1627719 | A1 * | 2/2006 |
| WO | WO 89/01123 | A1 | 2/1989 |
| WO | WO 97/00766 | A1 | 1/1997 |
| WO | WO 01/21668 | A1 | 3/2001 |
| WO | WO 2006/107197 | A1 | 10/2006 |
| WO | WO 2007/107359 | A1 | 9/2007 |

OTHER PUBLICATIONS

Sep. 30, 2008 Extended European Search Report issued in Application No. EP 08 00 4144.
Jul. 6, 2009 International Search Report issued in PCT/EP2009/052622.

* cited by examiner

*Primary Examiner* — Brent O'Hern
(74) *Attorney, Agent, or Firm* — Oliff Berridge, PLC

(57) ABSTRACT

A ballistic-resistant molded article comprising a compressed stack of sheets comprising reinforcing elongate bodies and an organic matrix material, the direction of the elongate bodies within the compressed stack being not unidirectionally, wherein the elongate bodies are tapes with a width of at least 2 mm and a thickness to width ratio of at least 10:1 with the stack comprising 0.2-8 wt. % of an organic matrix material.

14 Claims, No Drawings

BALLISTIC RESISTANT ARTICLES COMPRISING ELONGATE BODIES

BACKGROUND

The present invention pertains to ballistic resistant articles comprising elongate bodies, and to a method for manufacturing thereof.

Ballistic resistant articles comprising elongate bodies are known in the art.

EP 833 742 describes a ballistic resistant moulded article containing a compressed stack of monolayers, with each monolayer containing unidirectionally oriented fibres and at most 30 wt. % of an organic matrix material.

WO 2006/107197 describes a method for manufacturing a laminate of polymeric tapes in which polymeric tapes of the core-cladding type are used, in which the core material has a higher melting temperature than the cladding material, the method comprising the steps of biassing the polymeric tapes, positioning the polymeric tapes, and consolidating the polymeric tapes to obtain a laminate.

EP 1627719 describes a ballistic resistant article consisting essentially of ultra-high molecular weight polyethylene which comprises a plurality of unidirectionally oriented polyethylene sheets cross-plied at an angle with respect to each other and attached to each other in the absence of any resin, bonding matrix, or the like.

WO 89/01123 describes an improved impact-resistant composite and a helmet made thereof. The composite comprises prepreg layers comprising a plurality of unidirectional coplanar fibers embedded in a polymeric matrix.

U.S. Pat. No. 5,167,876 describes a ballistic resistant article with improved flame retardance, which composes a layer of a network of fibers in a matrix material It is indicated that fibers are dispersed in a continuous phase of a matrix material.

While the references mentioned above describe ballistic-resistant materials with adequate properties, there is still room for improvement. More in particular, there is need for a ballistic resistant material which combines a high ballistic performance with a low areal weight and a good stability, in particular well-controlled delamination properties. The present invention provides such a material.

SUMMARY

The present invention therefore pertains to a ballistic-resistant moulded article comprising a compressed stack of sheets comprising reinforcing elongate bodies and an organic matrix material, the direction of the elongate bodies within the compressed stack being not unidirectionally, wherein the elongate bodies are tapes with a width of at least 2 mm and a width to thickness ratio of at least 10:1 with the stack comprising 0.2-8 wt. % of an organic matrix material.

DETAILED DESCRIPTION OF EMBODIMENTS

It has been found that the selection of tapes with a width and width to thickness ratio in the claimed range in combination with the use of the specific amount of matrix material leads to a ballistic material with attractive properties. More in particular, this combined selection of properties leads to a ballistic material with an improved ballistic performance, in particular to a material with an improved ballistic performance, good peel strength, low areal weight, and good delamination properties. It is noted that this effect cannot be obtained by simply decreasing the content of matrix material present in the system, because a reduction of the content of matrix material without proper selection of the tape properties will lead to a material with unacceptable delamination properties and peel strength.

The tape used in the present invention is an object of which the length is larger than the width and the thickness, while the width is in turn larger than the thickness. In the tapes used in the present invention, the ratio between the width and the thickness is more than 10:1, in particular more than 20:1, more in particular more than 50:1; still more in particular more than 100:1. The maximum ratio between the width and the thickness is not critical to the present invention. It generally is at most 1000:1, depending on the tape width.

The width of the tape used in the present invention is at least 2 mm, in particular at least 10 mm, more in particular at least 20 mm. The width of the tape is not critical and may generally be at most 200 mm. The thickness of the tape is generally at least 8 microns, in particular at least 10 microns. The thickness of the tape is generally at most 150 microns, more in particular at most 100 microns.

The ratio between the length and the width of the tapes used in the present invention is not critical. It depends on the width of the tape and the size of the ballistic resistant moulded article. The ratio between length and width is at least 1. As a general value, a maximum length to width ratio of 1 000 000 may be mentioned.

Within the present specification, the term sheet refers to an individual sheet comprising tapes, which sheet can individually be combined with other, corresponding sheets. The sheet may or may not comprise a matrix material, as will be elucidated below.

Any natural or synthetic tapes may in principle be used in the present specification. Use may be made of for instance tapes made of metal, semimetal, inorganic materials, organic materials or combinations thereof. For application of the tapes in ballistic-resistant moulded parts it is essential that the tapes bodies be ballistically effective, which, more specifically, requires that they have a high tensile strength, a high tensile modulus and a high energy absorption, reflected in a high energy-to-break. It is preferred for the tapes to have a tensile strength of at least 1.0 GPa, a tensile modulus of at least 40 GPa, and a tensile energy-to-break of at least 15 J/g.

In one embodiment, the tensile strength of the tapes is at least 1.2 GPa, more in particular at least 1.5 GPa, still more in particular at least 1.8 GPa, even more in particular at least 2.0 GPa. Tensile strength is determined in accordance with ASTM D882-00.

In another embodiment, the tapes have a tensile modulus of at least 50 GPa. The modulus is determined in accordance with ASTM D822-00. More in particular, the tapes may have a tensile modulus of at least 80 GPa, more in particular at least 100 GPa.

In another embodiment, the tapes have a tensile energy to break of at least 20 J/g, in particular at least 25 J/g. The tensile energy to break is determined in accordance with ASTM D882-00 using a strain rate of 50%/min. It is calculated by integrating the energy per unit mass under the stress-strain curve.

Suitable inorganic tapes having a high tensile strength are for example carbon fibre tapes, glass fibre tapes, and ceramic fibre tapes. Suitable organic tapes having a high tensile strength are for example tapes made of aramid, of liquid crystalline polymer, and of highly oriented polymers such as polyolefins, polyvinylalcohol, and polyacrylonitrile.

In the present invention the use of homopolymers and copolymers of polyethylene and polypropylene is preferred.

These polyolefins may contain small amounts of one or more other polymers, in particular other alkene-1-polymers.

It is preferred for the tapes used in the present invention sheet to be high-drawn tapes of high-molecular weight linear polyethylene. High molecular weight here means a weight average molecular weight of at least 400 000 g/mol. Linear polyethylene here means polyethylene having fewer than 1 side chain per 100 C atoms, preferably fewer than 1 side chain per 300 C atoms. The polyethylene may also contain up to 5 mol % of one or more other alkenes which are copolymerisable therewith, such as propylene, butene, pentene, 4-methylpentene, octene.

It may be particularly preferred to use tapes of ultra-high molecular weight polyethylene (UHMWPE), that is, polyethylene with a weight average molecular weight of at least 500 000 g/mol. The use of tapes with a molecular weight of at least $1*10^6$ g/mol may be particularly preferred. The maximum molecular weight of the UHMWPE tapes suitable for use in the present invention is not critical. As a general value a maximum value of $1*10^8$ g/mol may be mentioned. The molecular weight distribution and molecular weigh averages (Mw, Mn, Mz) are determined in accordance with ASTM D 6474-99 at a temperature of 160° C. using 1,2,4-trichlorobenzene (TCB) as solvent. Appropriate chromatographic equipment (PL-GPC220 from Polymer Laboratories) including a high temperature sample preparation device (PL-SP260) may be used. The system is calibrated using sixteen polystyrene standards (Mw/Mn<1.1) in the molecular weight range $5*10^3$ to $8*10^6$ gram/mole.

The molecular weight distribution may also be determined using melt rheometry. Prior to measurement, a polyethylene sample to which 0.5 wt % of an antioxidant such as IRGANOX 1010 has been added to prevent thermo-oxidative degradation, would first be sintered at 50° C. and 200 bars. Disks of 8 mm diameter and thickness 1 mm obtained from the sintered polyethylenes are heated fast (~30° C./min) to well above the equilibrium melting temperature in the rheometer under nitrogen atmosphere. For an example, the disk was kept at 180 C for two hours or more. The slippage between the sample and rheometer discs may be checked with the help of an oscilloscope. During dynamic experiments two output signals from the rheometer i.e. one signal corresponding to sinusoidal strain, and the other signal to the resulting stress response, are monitored continuously by an oscilloscope. A perfect sinusoidal stress response, which can be achieved at low values of strain was an indicative of no slippage between the sample and discs. Rheometry may be carried out using a plate-plate rheometer such as Rheometrics RMS 800 from TA Instruments. The Orchestrator Software provided by the TA Instruments, which makes use of the Mead algorithm, may be used to determine molar mass and molar mass distribution from the modulus vs frequency data determined for the polymer melt. The data is obtained under isothermal conditions between 160-220° C. To get the good fit angular frequency region between 0.001 to 100 rad/s and constant strain in the linear viscoelastic region between 0.5 to 2% should be chosen. The time-temperature superposition is applied at a reference temperature of 190° C. To determine the modulus below 0.001 frequency (rad/s) stress relaxation experiments may be performed. In the stress relaxation experiments, a single transient deformation (step strain) to the polymer melt at fixed temperature is applied and maintained on the sample and the time dependent decay of stress is recorded.

As indicated above, the ballistic-resistant moulded article of the present invention comprises a compressed stack of sheets comprising reinforcing tapes and 0.2-8 wt. % of an organic matrix material. The term "matrix material" means a material which binds the tapes and/or the sheets together.

In one embodiment of the present invention, matrix material is provided within the sheets themselves, where it serves to adhere the tapes to each other.

In another embodiment of the present invention, matrix material is provided on the sheet, where it acts as a glue or binder to adhere the sheet to further sheets within the stacks. Obviously, the combination of these two embodiments is also envisaged.

In one embodiment of the present invention, the sheets themselves contain reinforcing tapes and a matrix material.

Sheets of this type may, for example, be manufactured as follows. In a first step, the tapes are provided in a layer, and then a matrix material is provided onto the layer under such conditions that the matrix material causes the tapes to adhere together. This embodiment is particularly attractive where the matrix material is in the form of a film. In one embodiment, the tapes are provided in a parallel arrangement.

Sheets of this type may, for a further example, also be manufactured by a process in which a layer of tapes is provided, a layer of a matrix material is applied onto the tapes, and a further layer of tapes is applied on top of the matrix. In one embodiment, the first layer of tapes encompasses tapes arranged in parallel and the second layer of tapes are arranged parallel to the tapes in the first layer but offset thereto. In another embodiment, the first layer of tapes is arranged in parallel, and the second layer of tapes is arranged crosswise on the first layer of tapes.

In one embodiment, the provision of the matrix material is effected by applying one or more films of matrix material to the surface, bottom or both sides of the plane of tapes and then causing the films to adhere to the tapes, e.g., by passing the films together with the tapes, through a heated pressure roll. However, the low amount of matrix material used in the present invention makes this method less preferred, as it will require the use of very thin polymer films.

In a preferred embodiment of the present invention, the tape layer is provided with an amount of a liquid substance containing the organic matrix material. The advantage of this is that more rapid and better impregnation of the tapes is achieved. The liquid substance may be for example a solution, a dispersion or a melt of the organic matrix material. If a solution or a dispersion of the matrix material is used in the manufacture of the sheet, the process also comprises evaporating the solvent or dispersant. This can for instance be accomplished by using an organic matrix material of very low viscosity in impregnating the tapes in the manufacture of the sheet. If so desired, the matrix material may be applied in vacuo.

In the case that the sheet itself does not contain a matrix material, the sheet may be manufactured by the steps of providing a layer of tapes and where necessary adhering the tapes together by the application of heat and pressure.

In one embodiment of this embodiment, the tapes overlap each other at least partially, and are then compressed to adhere to each other.

The matrix material will then be applied onto the sheets to adhere the sheets to each other during the manufacture of the ballistic material. The matrix material can be applied in the form of a film or, preferably, in the form of a liquid material, as discussed above for the application onto the tapes themselves.

In one embodiment of the present invention the matrix material is applied in the fowl of a web, wherein a web is a discontinuous polymer film, that is, a polymer film with holes. This allows the provision of low weights of matrix materials. Webs can be applied during the manufacture of the sheets, but also between the sheets.

In another embodiment of the present invention, the matrix material is applied in the form of strips, yarns, or fibres of polymer material, the latter for example in the form of a woven or non-woven yarn of fibre web or other polymeric fibrous weft. Again, this allows the provision of low weights of matrix materials. Strips, yarns or fibres can be applied during the manufacture of the sheets, but also between the sheets.

In a further embodiment of the present invention, the matrix material is applied in the form of a liquid material, as described above, where the liquid material may be applied homogeneously over the entire surface of the elongate body plane, or of the sheet, as the case may be. However, it is also possible to apply the matrix material in the form of a liquid material inhomogeneously over the surface of the elongate body plane, or of the sheet, as the case may be. For example, the liquid material may be applied in the form of dots or stripes, or in any other suitable pattern.

In various embodiments described above, the matrix material is distributed inhomogeneously over the sheets. In one embodiment of the present invention the matrix material is distributed inhomogeneously within the compressed stack. In this embodiment more matrix material may be provided there were the compressed stack encounters the most influences from outside which may detrimentally affect stack properties.

The organic matrix material may wholly or partially consist of a polymer material, which optionally may contain fillers usually employed for polymers. The polymer may be a thermoset or thermoplastic or mixtures of both. Preferably a soft plastic is used, in particular it is preferred for the organic matrix material to be an elastomer with a tensile modulus (at 25° C.) of at most 41 MPa. The use of non-polymeric organic matrix material is also envisaged. The purpose of the matrix material is to help to adhere the tapes and/or the sheets together where required, and any matrix material which attains this purpose is suitable as matrix material.

Preferably, the elongation to break of the organic matrix material is greater than the elongation to break of the reinforcing tapes. The elongation to break of the matrix preferably is from 3 to 500%. These values apply to the matrix material as it is in the final ballistic-resistant article.

Thermosets and thermoplastics that are suitable for the sheet are listed in for instance EP 833742 and WO-A-91/12136. Preferably, vinylesters, unsaturated polyesters, epoxides or phenol resins are chosen as matrix material from the group of thermosetting polymers. These thermosets usually are in the sheet in partially set condition (the so-called B stage) before the stack of sheets is cured during compression of the ballistic-resistant moulded article. From the group of thermoplastic polymers polyurethanes, polyvinyls, polyacrylates, polyolefins or thermoplastic, elastomeric block copolymers such as polyisoprene-polyethylenebutylene-polystyrene or polystyrene-polyisoprenepolystyrene block copolymers are preferably chosen as matrix material.

As indicated above, the matrix material is present in the compressed stack in an amount of 0.2-8 wt. %, calculated on the total of tapes and organic matrix material. The use of more than 8 wt. % of matrix material leads to a decrease of the ballistic performance of the panel at the same areal weight. Further, it was found not to further increase the peel strength, while only increasing the weight of the ballistic material.

On the other hand, it was found that if no matrix material is used at all, the delamination properties of the moulded article will be unacceptable. More in particular, when no matrix material is used, the moulded article will locally delaminate upon bullet impact. This results in a back face signature (i.e. a bulge at the back of the article above acceptable values. In extreme cases, the moulded article may even fall apart.

It may be preferred for the matrix material to be present in an amount of at least 1 wt. %, more in particular in an amount of at least 2 wt. %, in some instances at least 2.5 wt. %. In some embodiments it may be preferred for the matrix material to be present in a amount of at most 7 wt. %, sometimes at most 6.5 wt. %.

The low matrix content of the stack in the ballistic resistant article of the present invention allows the provision of a highly ballistic resistant low weight material. The compressed sheet stack of the present invention should meet the requirements of class II of the NIJ Standard—0101.04 P-BFS performance test. In a preferred embodiment, the requirements of class IIIa of said Standard are met, in an even more preferred embodiment, the requirements of class III are met, or the requirements of even higher classes.

This ballistic performance is preferably accompanied by a low areal weight, in particular an areal weight of at most 19 $kg/m^2$, more in particular at most 16 $kg/m^2$. In some embodiments, the areal weight of the stack may be as low as 15 $kg/m^2$. The minimum areal weight of the stack is given by the minimum ballistic resistance required.

The ballistic-resistant material according to the invention preferably has a peel strength of at least 5N, more in particular at least 5.5 N, determined in accordance with ASTM-D 1876-00, except that a head speed of 100 mm/minute is used.

Depending on the final use and on the thickness of the individual sheets, the number of sheets in the stack in the ballistic resistant article according to the invention is generally at least 2, in particular at least 4, more in particular at least 8. The number of sheets is generally at most 500, in particular at most 400.

In the present invention the direction of tapes within the compressed stack is not unidirectionally. This means that in the stack as a whole, tapes are oriented in different directions.

In one embodiment of the present invention the tapes in a sheet are unidirectionally oriented, and the direction of the tapes in a sheet is rotated with respect to the direction of the tapes of other sheets in the stack, more in particular with respect to the direction of the tapes in adjacent sheets. Good results are achieved when the total rotation within the stack amounts to at least 45 degrees. Preferably, the total rotation within the stack amounts to approximately 90 degrees. In one embodiment of the present invention, the stack comprises adjacent sheets wherein the direction of the tapes in one sheet is perpendicular to the direction of tapes in adjacent sheets.

The invention also pertains to a method for manufacturing a ballistic-resistant moulded article comprising the steps of providing sheets comprising reinforcing tapes with a width of at least 2 mm and a width to thickness ratio of at least 10:1, stacking the sheets in such a manner that the direction of the tapes within the compressed stack is not unidirectionally, and compressing the stack under a pressure of at least 0.5 MPa, wherein 0.2-8 wt. % of an organic matrix material is provided, either within the sheets, or as a polymer film between the sheets, or as a combination thereof.

In one embodiment of this process, the sheets are provided by providing a layer of tapes and causing the bodies to adhere. This can be done by the provision of a matrix material, or by compressing the bodies as such. In the latter embodiment the matrix material will be applied onto the sheets before stacking.

The pressure to be applied is intended to ensure the formation of a ballistic-resistant moulded article with adequate properties. The pressure is at least 0.5 MPa. A maximum pressure of at most 50 MPa may be mentioned.

Where necessary, the temperature during compression is selected such that the matrix material is brought above its softening or melting point, if this is necessary to cause the matrix to help adhere the tapes and/or sheets to each other. Compression at an elevated temperature is intended to mean that the moulded article is subjected to the given pressure for a particular compression time at a compression temperature above the softening or melting point of the organic matrix material and below the softening or melting point of the tapes.

The required compression time and compression temperature depend on the nature of the tape and matrix material and on the thickness of the moulded article and can be readily determined by the person skilled in the art.

Where the compression is carried out at elevated temperature, it may be preferred for the cooling of the compressed material to also take place under pressure. Cooling under pressure is intended to mean that the given minimum pressure is maintained during cooling at least until so low a temperature is reached that the structure of the moulded article can no longer relax under atmospheric pressure. It is within the scope of the skilled person to determine this temperature on a case by case basis. Where applicable it is preferred for cooling at the given minimum pressure to be down to a temperature at which the organic matrix material has largely or completely hardened or crystallized and below the relaxation temperature of the reinforcing tapes. The pressure during the cooling does not need to be equal to the pressure at the high temperature. During cooling, the pressure should be monitored so that appropriate pressure values are maintained, to compensate for decrease in pressure caused by shrinking of the moulded article and the press.

Depending on the nature of the matrix material, for the manufacture of a ballistic-resistant moulded article in which the reinforcing tapes in the sheet are high-drawn tapes of high-molecular weight linear polyethylene, the compression temperature is preferably 115 to 135° C. and cooling to below 70° C. is effected at a constant pressure. Within the present specification the temperature of the material, e.g., compression temperature refers to the temperature at half the thickness of the moulded article.

In the process of the invention the stack may be made starting from loose sheets. Loose sheets are difficult to handle, however, in that they easily tear in the direction of the tapes. It is therefore preferred to make the stack from consolidated sheet packages containing from 2 to 8, as a rule 2, 4 or 8. For the orientation of the sheets within the sheet packages, reference is made to what has been stated above for the orientation of the sheets within the compressed stack.

Consolidated is intended to mean that the sheets are firmly attached to one another. Very good results are achieved if the sheet packages, too, are compressed. The sheets may be consolidated by the application of heat and/or pressure, as is known in the art.

In a preferred embodiment of the present invention, polyethylene tapes are used which have a high molecular weight and a narrow molecular weight distribution. It has been found that especially in the case of this material the use of 0.2-8 wt. % of matrix material is particularly advantageous. It is believed that it will be difficult to convert polyethylene tapes with a high molecular weight and a narrow molecular weight distribution to a ballistic material with suitable properties without the use of any matrix material. The use of 8 wt. % or less of a matrix material results in a ballistic material where the advantageous ballistic properties of this polyethylene are used to their full advantage. More in particular, the selection of a material with a narrow molecular weight distribution leads to the formation of a material with a homogeneous crystalline structure, and therewith to improved mechanical properties and fracture toughness.

In this embodiment of the present invention, at least some of the tapes are polyethylene tapes which have a weight average molecular weight of at least 100 000 gram/mole and an Mw/Mn ratio of at most 6.

Within this embodiment it is preferred for at least 20 wt. %, calculated on the total weight of the tapes present in the ballistic resistant moulded article to meet these requirements, in particular at least 50 wt. %, more in particular, at least 75 wt. %, still more in particular at least 85 wt. %, or at least 95 wt. %. In one embodiment, all of the tapes present in the ballistic resistant moulded article meet these requirements.

The tapes used in this embodiment have a weight average molecular weight (Mw) of at least 100 000 gram/mole, in particular at least 300 000 gram/mole, more in particular at least 400 000 gram/mole, still more in particular at least 500 000 gram/mole, in particular between $1.10^6$ gram/mole and $1.10^8$ gram/mole.

The molecular weight distribution of the tapes used in this embodiment is relatively narrow. This is expressed by the Mw (weight average molecular weight) over Mn (number average molecular weight) ratio of at most 6. More in particular the Mw/Mn ratio is at most 5, still more in particular at most 4, even more in particular at most 3. The use of materials with an Mw/Mn ratio of at most 2.5, or even at most 2 is envisaged in particular.

In addition to the molecular weight and Mw/Mn requirements, it is preferred for the tapes to have a high tensile strength, a high tensile modulus and a high energy absorption, reflected in a high energy-to-break.

In one embodiment, the tensile strength of these tapes is at least 2.0 GPa, in particular at least 2.5 GPa, more in particular at least 3.0 GPa, still more in particular at least 4 GPa. Tensile strength is determined in accordance with ASTM D882-00.

In another embodiment, these tapes have a tensile modulus of at least 80 GPa, more in particular at least 100 GPa, still more in particular at least 120 GPa, even more in particular at least 140 GPa, or at least 150 GPa. The modulus is determined in accordance with ASTM D822-00.

In another embodiment, the tapes have a tensile energy to break of at least 30 J/g, in particular at least 35 J/g, more in particular at least 40 J/g, still more in particular at least 50 J/g. The tensile energy to break is determined in accordance with ASTM D882-00 using a strain rate of 50%/min. It is calculated by integrating the energy per unit mass under the stress-strain curve.

In a preferred embodiment of the present invention the polyethylene tapes with a high molecular weight and the stipulated narrow molecular weight distribution have a high molecular orientation as is evidenced by their XRD diffraction pattern.

In one embodiment of the present invention, the tapes have a 200/110 uniplanar orientation parameter Φ of at least 3. The 200/110 uniplanar orientation parameter Φ is defined as the ratio between the 200 and the 110 peak areas in the X-ray diffraction (XRD) pattern of the tape sample as determined in reflection geometry.

Wide angle X-ray scattering (WAXS) is a technique that provides information on the crystalline structure of matter. The technique specifically refers to the analysis of Bragg peaks scattered at wide angles. Bragg peaks result from long-range structural order. A WAXS measurement produces a diffraction pattern, i.e. intensity as function of the diffraction angle 2θ (this is the angle between the diffracted beam and the primary beam).

The 200/110 uniplanar orientation parameter gives information about the extent of orientation of the 200 and 110 crystal planes with respect to the tape surface. For a tape sample with a high 200/110 uniplanar orientation the 200 crystal planes are highly oriented parallel to the tape surface. It has been found that a high uniplanar orientation is generally accompanied by a high tensile strength and high tensile energy to break. The ratio between the 200 and 110 peak areas for a specimen with randomly oriented crystallites is around 0.4. However, in the tapes that are preferentially used in one embodiment of the present invention the crystallites with indices 200 are preferentially oriented parallel to the film surface, resulting in a higher value of the 200/110 peak area ratio and therefore in a higher value of the uniplanar orientation parameter.

The value for the 200/110 uniplanar orientation parameter may be determined using an X-ray diffractometer. A Bruker-AXS D8 diffractometer equipped with focusing multilayer X-ray optics (Gobel mirror) producing Cu-Kα radiation (K wavelength=1.5418 Å) is suitable. Measuring conditions: 2 mm anti-scatter slit, 0.2 mm detector slit and generator setting 40 kV, 35 mA. The tape specimen is mounted on a sample holder, e.g. with some double-sided mounting tape. The preferred dimensions of the tape sample are 15 mm×15 mm (l×w). Care should be taken that the sample is kept perfectly flat and aligned to the sample holder. The sample holder with the tape specimen is subsequently placed into the D8 diffractometer in reflection geometry (with the normal of the tape perpendicular to the goniometer and perpendicular to the sample holder). The scan range for the diffraction pattern is from 5° to 40° (2θ) with a step size of 0.02° (20) and a counting time of 2 seconds per step. During the measurement the sample holder spins with 15 revolutions per minute around the normal of the tape, so that no further sample alignment is necessary. Subsequently the intensity is measured as function of the diffraction angle 2θ. The peak area of the 200 and 110 reflections is determined using standard profile fitting software, e.g. Topas from Bruker-AXS. As the 200 and 110 reflections are single peaks, the fitting process is straightforward and it is within the scope of the skilled person to select and carry out an appropriate fitting procedure. The 200/110 uniplanar orientation parameter is defined as the ratio between the 200 and 110 peak areas. This parameter is a quantitative measure of the 200/110 uniplanar orientation.

The UHMWPE tapes with narrow molecular weight distribution used in one embodiment of the ballistic material according to the invention have a 200/110 uniplanar orientation parameter of at least 3. It may be preferred for this value to be at least 4, more in particular at least 5, or at least 7. Higher values, such as values of at least 10 or even at least 15 may be particularly preferred. The theoretical maximum value for this parameter is infinite if the peak area 110 equals zero. High values for the 200/110 uniplanar orientation parameter are often accompanied by high values for the strength and the energy to break.

In one embodiment of the present invention, the UHMWPE tapes, in particular UHMWPE tapes with an Mw/MN ratio of at most 6 have a DSC crystallinity of at least 74%, more in particular at least 80%. The DSC crystallinity can be determined as follows using differential scanning calorimetry (DSC), for example on a Perkin Elmer DSC7. Thus, a sample of known weight (2 mg) is heated from 30 to 180° C. at 10° C. per minute, held at 180° C. for 5 minutes, then cooled at 10° C. per minute. The results of the DSC scan may be plotted as a graph of heat flow (mW or mJ/s; y-axis) against temperature (x-axis). The crystallinity is measured using the data from the heating portion of the scan. An enthalpy of fusion ΔH (in J/g) for the crystalline melt transition is calculated by determining the area under the graph from the temperature determined just below the start of the main melt transition (endotherm) to the temperature just above the point where fusion is observed to be completed. The calculated ΔH is then compared to the theoretical enthalpy of fusion ($\Delta H_c$ of 293 J/g) determined for 100% crystalline PE at a melt temperature of approximately 140° C. A DSC crystallinity index is expressed as the percentage 100 ($\Delta H/\Delta H_c$). In one embodiment, the tapes used in the present invention have a DSC crystallinity of at least 85%, more in particular at least 90%.

The polyethylene used in this embodiment of the present invention can be a homopolymer of ethylene or a copolymer of ethylene with a co-monomer which is another alpha-olefin or a cyclic olefin, both with generally between 3 and 20 carbon atoms. Examples include propene, 1-butene, 1-pentene, 1-hexene, 1-heptene, 1-octene, cyclohexene, etc. The use of dienes with up to 20 carbon atoms is also possible, e.g., butadiene or 1-4 hexadiene. The amount of non-ethylene alpha-olefin in the ethylene homopolymer or copolymer used in the process according to the invention preferably is at most 10 mole %, preferably at most 5 mole %, more preferably at most 1 mole %. If a non-ethylene alpha-olefin is used, it is generally present in an amount of at least 0.001 mol. %, in particular at least 0.01 mole %, still more in particular at least 0.1 mole %. The use of a material which is substantially free from non-ethylene alpha-olefin is preferred. Within the context of the present specification, the wording substantially free from non-ethylene alpha-olefin is intended to mean that the only amount non-ethylene alpha-olefin present in the polymer are those the presence of which cannot reasonably be avoided.

In general, the UHMWPE tapes, in particular those with a narrow molecular weight distribution, have a polymer solvent content of less than 0.05 wt. %, in particular less than 0.025 wt. %, more in particular less than 0.01 wt. %.

The tapes used in the present invention, in particular the UHMWPE tapes with a narrow molecular weight distribution may have a high strength in combination with a high linear density. In the present application the linear density is expressed in dtex. This is the weight in grams of 10.000 meters of film. In one embodiment, the film according to the invention has a denier of at least 3000 dtex, in particular at least 5000 dtex, more in particular at least 10000 dtex, even more in particular at least 15000 dtex, or even at least 20000 dtex, in combination with strengths of, as specified above, at least 2.0 GPa, in particular at least 2.5 GPa, more in particular at least 3.0 GPa, still more in particular at least 3.5 GPa, and even more in particular at least 4.

In one embodiment of the present invention, the polyethylene tapes with a narrow molecular weight distribution are tapes manufactured by a process which comprises subjecting a starting polyethylene with a weight average molecular weight of at least 100 000 gram/mole, an elastic shear modulus $G_N^0$, determined directly after melting at 160° C. of at most 1.4 MPa, and a Mw/Mn ratio of at most 6 to a compacting step and a stretching step under such conditions that at no point during the processing of the polymer its temperature is raised to a value above its melting point.

The starting material for said manufacturing process is a highly disentangled UHMWPE. This can be seen from the combination of the weight average molecular weight, the Mw/Mn ratio, and the elastic modulus. For further elucidation and preferred embodiments as regards the molecular weight and the Mw/Mn ratio of the starting polymer, reference is made to what has been stated above for the MwMn tapes. In particular, in this process it is preferred for the starting polymer to have a weight average molecular weight of at least 500 000 gram/mole, in particular between $1.10^6$ gram/mole and $1.10^8$ gram/mole.

As indicated above, the starting polymer has an elastic shear modulus $G_N^0$ determined directly after melting at 160° C. of at most 1.4 MPa, more in particular at most 1.0 MPa, still more in particular at most 0.9 MPa, even more in particular at most 0.8 MPa, and even more in particular at most 0.7. The wording "directly after melting" means that the elastic modulus is determined as soon as the polymer has melted, in particular within 15 seconds after the polymer has melted. For this polymer melt, the elastic modulus typically increases from 0.6 to 2.0 MPa in several hours.

The elastic shear modulus directly after melting at 160° C. is a measure for the degree of entangledness of the polymer. $G_N^0$ is the elastic shear modulus in the rubbery plateau region. It is related to the average molecular weight between entanglements Me, which in turn is inversely proportional to the entanglement density. In a thermodynamically stable melt having a homogeneous distribution of entanglements, Me can be calculated from $G_N^0$ via the formula $G_N^0=g_N\rho RT/M_e$, where $g_N$ is a numerical factor set at 1, rho is the density in g/cm3, R is the gas constant and T is the absolute temperature in K. A low elastic modulus thus stands for long stretches of polymer between entanglements, and thus for a low degree of entanglement. The adopted method for the investigation on changes in with the entanglements formation is the same as described in publications (Rastogi, S., Lippits, D., Peters, G., Graf, R., Yefeng, Y. and Spiess, H., "Heterogeneity in Polymer Melts from Melting of Polymer Crystals", Nature Materials, 4 (8), 1 Aug. 2005, 635-641 and PhD thesis Lippits, D. R., "Controlling the melting kinetics of polymers; a route to a new melt state", Eindhoven University of Technology, dated 6 Mar. 2007, ISBN 978-90-386-0895-2).

The starting polyethylene for use in this embodiment may be manufactured by a polymerisation process wherein ethylene, optionally in the presence of other monomers as discussed above, is polymerised in the presence of a single-site polymerisation catalyst at a temperature below the crystallisation temperature of the polymer, so that the polymer crystallises immediately upon formation. This will lead to a material with an Mw/Mn ratio in the claimed range.

In particular, reaction conditions are selected such that the polymerisation speed is lower than the crystallisation speed. These synthesis conditions force the molecular chains to crystallize immediately upon their formation, leading to a rather unique morphology which differs substantially from the one obtained from the solution or the melt. The crystalline morphology created at the surface of a catalyst will highly depend on the ratio between the crystallization rate and the growth rate of the polymer. Moreover, the temperature of the synthesis, which is in this particular case also crystallization temperature, will strongly influence the morphology of the obtained UHMW-PE powder. In one embodiment the reaction temperature is between −50 and +50° C., more in particular between −15 and +30° C. It is well within the scope of the skilled person to determine via routine trial and error which reaction temperature is appropriate in combination with which type of catalyst, polymer concentrations and other parameters influencing the reaction. To obtain a highly disentangled polyethylene, in particular UHMWPE, it is important that the polymerisation sites are sufficiently far removed from each other to prevent entangling of the polymer chains during synthesis. This can be done using a single-site catalyst which is dispersed homogenously through the crystallisation medium in low concentrations. More in particular, concentrations less than $1.10^{-4}$ mol catalyst per liter, in particular less than $1.10^{-5}$ mol catalyst per liter reaction medium may be appropriate. Supported single site catalyst may also be used, as long as care is taken that the active sites are sufficiently far removed from each other to prevent substantial entanglement of the polymers during formation. Suitable methods for manufacturing polyethylenes used in the present invention are known in the art. Reference is made, for example, to WO01/21668 and US20060142521.

The disentangled UHMWPE that may be used in the present invention may have a bulk density which is significantly lower than the bulk density of conventional UWMW-PEs. More in particular, the UHMWPE used in the process according to the invention may have a bulk density below 0.25 g/cm$^3$, in particular below 0.18 g/cm$^3$, still more in particular below 0.13 g/cm$^3$. The bulk density may be determined in accordance with ASTM-D1895. A fair approximation of this value can be obtained as follows. A sample of UHMWPE powder is poured into a measuring beaker of exact 100 ml. After scraping away the surplus of material, the weight of the content of the beaker is determined and the bulk density is calculated.

The polymer is provided in particulate form, for example in the form of a powder, or in any other suitable particulate form. Suitable particles have a particle size of up to 5000 micron, preferably up to 2000 micron, more in particular up to 1000 micron. The particles preferably have a particle size of at least 1 micron, more in particular at least 10 micron. The particle size distribution may be determined by laser diffraction (PSD, Sympatec Quixel) as follows. The sample is dispersed into surfactant-containing water and treated ultrasonic for 30 seconds to remove agglomerates/entanglements. The sample is pumped through a laser beam and the scattered light is detected. The amount of light diffraction is a measure for the particle size.

The compacting step is carried out to integrate the polymer particles into a single object, e.g., in the form of a mother sheet. The stretching step is carried out to provide orientation to the polymer and manufacture the final product. The two steps are carried out at a direction perpendicular to each other. It is noted that it is within the scope of the present invention to combine these elements in a single step, or to carry out the process in different steps, each step performing one or more of the compacting and stretching elements. For example, in one embodiment of the process according to the invention, the process comprises the steps of compacting the polymer powder to form a mothersheet, rolling the plate to form rolled mothersheet and subjecting the rolled mothersheet to a stretching step to form a polymer film.

The compacting force applied in the process according to the invention generally is 10-10000 N/cm$^2$, in particular 50-5000 N/cm2, more in particular 100-2000 N/cm$^2$. The density of the material after compacting is generally between 0.8 and 1 kg/dm$^3$, in particular between 0.9 and 1 kg/dm$^3$.

In the process according to the invention the compacting and rolling step is generally carried out at a temperature of at least 1° C. below the unconstrained melting point of the polymer, in particular at least 3° C. below the unconstrained melting point of the polymer, still more in particular at least 5° C. below the unconstrained melting point of the polymer. Generally, the compacting step is carried out at a temperature of at most 40° C. below the unconstrained melting point of the polymer, in particular at most 30° C. below the unconstrained melting point of the polymer, more in particular at most 10° C.

In the process according to the invention the stretching step is generally carried out at a temperature of at least 1° C. below the melting point of the polymer under process conditions, in particular at least 3° C. below the melting point of the polymer under process conditions, still more in particular at least 5° C. below the melting point of the polymer under process conditions. As the skilled person is aware, the melting point of polymers may depend upon the constraint under which they are put. This means that the melting temperature under process conditions may vary from case to case. It can easily be determined as the temperature at which the stress tension in the process drops sharply. Generally, the stretching step is carried out at a temperature of at most 30° C. below the melting point of the polymer under process conditions, in particular at most 20° C. below the melting point of the polymer under process conditions, more in particular at most 15° C.

In one embodiment of the present invention, the stretching step encompasses at least two individual stretching steps, wherein the first stretching step is carried out at a lower temperature than the second, and optionally further, stretching steps. In one embodiment, the stretching step encompasses at least two individual stretching steps wherein each further stretching step is carried out at a temperature which is higher than the temperature of the preceding stretching step.

As will be evident to the skilled person, this method can be carried out in such a manner that individual steps may be identified, e.g., in the form of the films being fed over individual hot plates of a specified temperature. The method can also be carried out in a continuous manner, wherein the film is subjected to a lower temperature in the beginning of the stretching process and to a higher temperature at the end of the stretching process, with a temperature gradient being applied in between. This embodiment can for example be carried out by leading the film over a hot plate which is equipped with temperature zones, wherein the zone at the end of the hot plate nearest to the compaction apparatus has a lower temperature than the zone at the end of the hot plate furthest from the compaction apparatus.

In one embodiment, the difference between the lowest temperature applied during the stretching step and the highest temperature applied during the stretching step is at least 3° C., in particular at least 7° C., more in particular at least 10° C. In general, the difference between the lowest temperature applied during the stretching step and the highest temperature applied during the stretching step is at most 30° C., in particular at most 25° C.

The unconstrained melting temperature of the starting polymer is between 138 and 142° C. and can easily be determined by the person skilled in the art. With the values indicated above this allows calculation of the appropriate operating temperature. The unconstrained melting point may be determined via DSC (differential scanning calorimetry) in nitrogen, over a temperature range of +30 to +180° C. and with an increasing temperature rate of 10° C./minute. The maximum of the largest endothermic peak at from 80 to 170° C. is evaluated here as the melting point.

In the conventional processing of UHMWPE it was necessary to carry out the process at a temperature which was very close to the melting temperature of the polymer, e.g., within 1 to 3 degrees therefrom. It has been found that the selection of the specific starting UHMWPE makes it possible to operate at values which are more below the melting temperature of the polymer than has been possible in the prior art. This makes for a larger temperature operating window which makes for better process control.

It has also been found that, as compared to conventional processing of UHMWPE, materials with a strength of at least 2 GPa can be manufactured at higher deformation speeds. The deformation speed is directly related to the production capacity of the equipment. For economical reasons it is important to produce at a deformation rate which is as high as possible without detrimentally affecting the mechanical properties of the film. In particular, it has been found that it is possible to manufacture a material with a strength of at least 2 GPa by a process wherein the stretching step that is required to increase the strength of the product from 1.5 GPa to at least 2 GPa is carried out at a rate of at least 4% per second. In conventional polyethylene processing it is not possible to carry out this stretching step at this rate. While in conventional UHMWPE processing the initial stretching steps, to a strength of, say, 1 or 1.5 GPa may be carried out at a rate of above 4% per second, the final steps, required to increase the strength of the film to a value of 2 GPa or higher, must be carried out at a rate well below 4% per second, as otherwise the film will break. In contrast, in the process according to the invention it has been found that it is possible to stretch intermediate film with a strength of 1.5 GPa at a rate of at least 4% per second, to obtain a material with a strength of at least 2 GPa. For further preferred values of the strength reference is made to what has been stated above. It has been found that the rate applied in this step may be at least 5% per second, at least 7% per second, at least 10% per second, or even at least 15% per second.

The strength of the film is related to the stretching ratio applied. Therefore, this effect can also be expressed as follows. In one embodiment of the invention, the stretching step of the process according to the invention can be carried out in such a manner that the stretching step from a stretching ratio of 80 to a stretching ratio of at least 100, in particular at least 120, more in particular at least 140, still more in particular of at least 160 is carried out at the stretching rate indicated above.

In still a further embodiment, the stretching step of the process according to the invention can be carried out in such a manner that the stretching step from a material with a modulus of 60 GPa to a material with a modulus of at least at least 80 GPa, in particular at least 100 GPa, more in particular at least 120 GPa, at least 140 GPa, or at least 150 GPa is carried out at the rate indicated above.

In will be evident to the skilled person that the intermediate products with a strength of 1.5 GPa, a stretching ratio of 80, and/or a modulus of 60 GPa are used, respectively, as starting point for the calculation of when the high-rate stretching step starts. This does not mean that a separately identifiable stretching step is carried out where the starting material has the specified value for strength, stretching ratio, or modulus. A product with these properties may be formed as intermediate product during a stretching step. The stretching ratio will then be calculated back to a product with the specified starting properties. It is noted that the high stretching rate described above is dependent upon the requirement that all stretching steps, including the high-rate stretching step or steps are carried out at a temperature below the inciting point of the polymer under process conditions.

In this manufacturing process the polymer is provided in particulate form, for example in the form of a powder. The compacting step is carried out to integrate the polymer particles into a single object, e.g., in the form of a mother sheet. The stretching step is carried out to provide orientation to the polymer and manufacture the final product. The two steps are carried out at a direction perpendicular to each other. It is noted that these elements may be combined in a single step, or may be carried out in separate steps, each step performing one or more of the compacting and stretching elements. For example, in one embodiment the process comprises the steps of compacting the polymer powder to form a mothersheet, rolling the plate to form rolled mothersheet and subjecting the rolled mothersheet to a stretching step to form a polymer film.

The compacting force applied in the process according to the invention generally is 10-10000 N/cm$^2$, in particular 50-5000 N/cm$^2$, more in particular 100-2000 N/cm$^2$. The density of the material after compacting is generally between 0.8 and 1 kg/dm$^3$, in particular between 0.9 and 1 kg/dm$^3$.

The compacting and rolling step is generally carried out at a temperature of at least 1° C. below the unconstrained melting point of the polymer, in particular at least 3° C. below the unconstrained melting point of the polymer, still more in particular at least 5° C. below the unconstrained melting point of the polymer. Generally, the compacting step is carried out at a temperature of at most 40° C. below the unconstrained melting point of the polymer, in particular at most 30° C. below the unconstrained melting point of the polymer, more in particular at most 10° C.

The stretching step is generally carried out at a temperature of at least 1° C. below the melting point of the polymer under process conditions, in particular at least 3° C. below the melting point of the polymer under process conditions, still more in particular at least 5° C. below the melting point of the polymer under process conditions. As the skilled person is aware, the melting point of polymers may depend upon the constraint under which they are put. This means that the melting temperature under process conditions may vary from case to case. It can easily be determined as the temperature at which the stress tension in the process drops sharply. Generally, the stretching step is carried out at a temperature of at most 30° C. below the melting point of the polymer under process conditions, in particular at most 20° C. below the melting point of the polymer under process conditions, more in particular at most 15° C.

The unconstrained melting temperature of the starting polymer in this embodiment is between 138 and 142° C. and can easily be determined by the person skilled in the art. With the values indicated above this allows calculation of the appropriate operating temperature. The unconstrained melting point may be determined via DSC (differential scanning calorimetry) in nitrogen, over a temperature range of +30 to +180° C. and with an increasing temperature rate of 10° C./minute. The maximum of the largest endothermic peak at from 80 to 170° C. is evaluated here as the melting point.

Conventional apparatus may be used to carry out the compacting step. Suitable apparatus include heated rolls, endless belts, etc.

The stretching step is carried out to manufacture the polymer film. The stretching step may be carried out in one or more steps in a manner conventional in the art. A suitable manner includes leading the film in one or more steps over a set of rolls both rolling in process direction wherein the second roll rolls faster that the first roll. Stretching can take place over a hot plate or in an air circulation oven.

The total stretching ratio may be at least 80, in particular at least 100, more in particular at least 120, still more in particular at least 140, even more in particular at least 160. The total stretching ratio is defined as the area of the cross-section of the compacted mothersheet divided by the cross-section of the drawn film produced from this mothersheet.

The process is carried out in the solid state. The final polymer film has a polymer solvent content of less than 0.05 wt. %, in particular less than 0.025 wt. %, more in particular less than 0.01 wt. %.

The present invention is illustrated by the following examples, without being limited thereto or thereby.

EXAMPLES

Example 1

A ballistic material according to the invention was manufactured as follows.

The starting material consisted of UHMW polyethylene tapes with a width of 25 mm and a thickness of 50 μm. The tapes had a tensile strength of 1.84 GPa, a tensile modulus of 146 GPa, and a density of 920 kg/m3. The polyethylene had a molecular weight Mw of 4.3 $10^6$ gram/mole and a Mw/Mn ratio of 9.79.

Sheets were manufactured by aligning tapes in parallel to form a first layer, aligning a at least one further layer of tapes onto the first layer parallel and offset to the tapes in the first layer, and heat-pressing the tape layers to form a sheet.

Matrix was applied onto the sheets in a homogeneous layer. The matrix material used was Prinlin B7137 AL, commercially available from Henkel.

Sheets were cross-plied to form a stack. The stack was compressed at a temperature of 136-137° C., at a pressure of 60 bar. The material was cooled down and removed from the press to form a ballistic-resistant moulded article. The panel had an areal weight of 19.2 kg/m2 and a matrix content of 4.0 wt. %.

The panel was tested for ballistic properties in accordance with NIJ III 0.108.01 (hard armour). The panel passed the test. It was found that with a bullet velocity of 857 m/s a tunnel length of 8.9 mm was obtained. The tunnel length is the length of the tunnel between the entrance of the bullet in the panel and the point where the bullet starts to disintegrate to form a balloon.

Comparative Example 1

A comparative ballistic material was manufactured, analogous to what is described in Example 1, except that a higher amount of matrix was used. The resulting panel had an areal weight of 19.8 kg/m2 and a matrix content of 9.3 wt. %.

The plate was also tested for ballistic performance in accordance with NIJ III 0.108.01 (hard armour). The panel passed the test. It was found that with a bullet velocity of 842 m/s a tunnel length of 10.03 mm was obtained. With a bullet velocity of 886 m/s a tunnel length of 10.42 mm was obtained.

In comparison with the panel according to the invention of Example 1, the comparative panel shows a longer tunnel length, even at a lower bullet velocity. This means that the bullet disintegrates more at the back of the panel, and this increases the risk that the bullet will penetrate through the panel.

Comparative Example 2

A comparative ballistic material was manufactured analogous to what is described in Example 1, except that no matrix was used. The resulting panel had an areal weight of 19.6 kg/m2 and a matrix content of 0 wt. %.

The plate was also tested for ballistic performance in accordance with NIJ III 0.108.01 (hard armour), with a bullet velocity of 849 m/s. Even though the panel did stop the bullet, it failed the test. The panel delaminated into two parts. The back face signature depth was above 100 mm. A value for the back face signature depth above 44 mm is unacceptable from a commercial point of view.

Example 2

A ballistic material according to the invention was manufactured analogous to what is described in Example 1. The resulting plate had an areal weight of 3.5 kg/m2 and a matrix content of 4 wt. %.

The plate was tested for ballistic performance in accordance with NTJ IIIA 0.101.04, with a bullet velocity of 434 m/s. It was found that the plate passed the test.

The invention claimed is:

1. A ballistic-resistant moulded article comprising a compressed stack of sheets comprising reinforcing elongate bodies and an organic matrix material, a direction of the elongate bodies within the compressed stack being not unidirectional, wherein the elongate bodies are tapes with a width of at least 2 mm and a width to thickness ratio of at least 10:1 with the stack comprising 0.2-8 wt. % of the organic matrix material, and the tapes are polyethylene tapes having a 200/110 uniplanar orientation parameter of at least 3, the 200/110 planar orientation parameter being defined as a ratio between the 200 peak and the 110 peak areas in an X-ray diffraction (XRD) pattern of a sample of the tape as determined in reflection geometry.

2. The ballistic-resistant moulded article according to claim 1, wherein the width to thickness ratio of the tapes is more than 20:1.

3. The ballistic-resistant moulded article according to claim 1, wherein the width of the tape is at least 10 mm.

4. The ballistic-resistant moulded article according to claim 1, wherein the tapes in the sheets are unidirectionally oriented, and the direction of the tapes in a sheet is rotated with respect to the direction of the tapes in an adjacent sheet.

5. The ballistic-resistant moulded article according to claim 1, wherein a sheet comprises reinforcing tapes and 0.2-8 wt. % of organic matrix material.

6. The ballistic-resistant moulded article according to claim 1, wherein at least some of the sheets are substantially free from matrix material and matrix material is present between the sheets.

7. The ballistic-resistant moulded article according to claim 1, wherein the tapes have a tensile strength of at least 1.0 GPa, a tensile modulus of at least 40 GPa, and a tensile energy-to-break of at least 15 J/g.

8. The ballistic-resistant moulded article according to claim 1, wherein the tapes are of ultra-high molecular weight polyethylene (UHMWPE) with a weight average molecular weight of at least 500 000 g/mol.

9. The ballistic-resistant moulded article according to claim 1, wherein at least some of the polyethylene tapes have a weight average molecular weight of at least 100 000 g/mol and a Mw/Mn ratio of at most 6.

10. The ballistic-resistant moulded article according to claim 9, wherein the polyethylene tapes have a weight average molecular weight of at least 300 000 g/mol, and a Mw/Mn ratio of at most 5.

11. A consolidated sheet package suitable for use in the manufacture of the ballistic-resistant moulded article of claim 1, the consolidated sheet package comprising 2-8 sheets comprising reinforcing tapes, and an organic matrix material, a direction of the tapes within the sheet package being not unidirectional, and the sheet package comprising 0.2-8 wt. % of the organic matrix material, wherein the tapes are polyethylene tapes having a 200/110 uniplanar orientation parameter of at least 3, the 200/110 uniplanar orientation parameter being defined as a ratio between the 200 peak and the 110 peak areas in an X-ray diffraction (XRD) pattern of a sample of the tape as determined in reflection geometry.

12. A method for manufacturing the ballistic-resistant moulded article according to claim 1, comprising:

providing sheets comprising reinforcing tapes;

stacking the sheets in such a manner that a direction of the tapes within the stack is not unidirectional; and compressing the stack under a pressure of at least 0.5 MPa, wherein the compressed stack comprises 0.2-8 wt. % of an organic matrix material provided within the sheets, between the sheets, or both within and between the sheets, and the tapes are polyethylene tapes having a 200/110 uniplanar orientation parameter of at least 3, the 200/110 uniplanar orientation parameter being defined as a ratio between the 200 peak and the 110 peak areas in an X-ray diffraction (XRD) pattern of a sample of the tape as determined in reflection geometry.

13. The method according to claim 12, wherein the sheets are provided by providing a layer of tapes and causing the tapes to adhere.

14. The method according to claim 13, wherein tapes are caused to adhere via compression.

* * * * *

UNITED STATES PATENT AND TRADEMARK OFFICE

CERTIFICATE OF CORRECTION

PATENT NO. : 8,545,961 B2
APPLICATION NO. : 12/920608
DATED : October 1, 2013
INVENTOR(S) : Ernst Michael Winkler et al.

It is certified that error appears in the above-identified patent and that said Letters Patent is hereby corrected as shown below:

On the Title Page

Item (73), please change "Arhem" to --Arnhem--;

Item (74), please change "Oliff Berridge, PLC" to --Oliff & Berridge, PLC--;

In the Specification

Column 1, line 34, please change "matrix material It is" to --matrix material. It is--;

Column 3, line 40, please change "at 180 C for" to --at 180° C. for--;

Column 3, line 47, please change "was an indicative of" to --was indicative of--;

Column 4, line 65, please change "in the fowl of a web," to --in the form of a web,--;

Column 5, line 26, please change "were the compressed" to --where the compressed--;

Column 6, line 2, please change "of the article above" to --of the article) above--;

Column 6, line 8, please change "present in a amount" to --present in an amount--;

Column 9, line 22, please change "(Gobel mirror)" to --(Göbel mirror)--;

Column 11, line 25, please change "rho is the density in" to --ρ is the density in--;

Column 11, line 26, please change "g/cm3," to --g/cm$^3$,--;

Column 12, line 54, please change "N/cm2, more in" to --N/cm$^2$, more in--;

Column 14, line 58, please change "below the inciting point" to --below the melting point--;

Signed and Sealed this
Eleventh Day of February, 2014

Michelle K. Lee

Michelle K. Lee
*Deputy Director of the United States Patent and Trademark Office*

Column 17, line 8, please change “with NTJ IIIA” to --with NIJ IIIA--;

In the Claims

Column 17, Claim 1, line 21-22, please change “planar orientation” to --uniplanar orientation--.